US012281791B2

(12) United States Patent
Müller et al.

(10) Patent No.: US 12,281,791 B2
(45) Date of Patent: Apr. 22, 2025

(54) DEVICE AND METHOD FOR PRODUCING PRESSURE WAVES OF HIGH AMPLITUDE

(71) Applicants: Explo Engineering AG, Niederlenz (CH); MARTIN GmbH für Umwelt- und Energietechnik, Munich (DE); Hans Rüegg, Waltenschwil (CH); Hitachi Zosen Inova AG, Zürich (CH)

(72) Inventors: Paul Müller, Greppen (CH); Harald Herz, Baden (CH)

(73) Assignees: Explo Engineering AG, Niederlenz (CH); MARTIN GmbH für Umwelt- und Energietechik, Munich (DE); Hans Rüegg, Waltenschwil (CH); Kanadevia Inova AG, Zürich (CH)

( * ) Notice: Subject to any disclaimer, the term of this patent is extended or adjusted under 35 U.S.C. 154(b) by 1092 days.

(21) Appl. No.: 17/042,684

(22) PCT Filed: Mar. 27, 2019

(86) PCT No.: PCT/EP2019/057752
§ 371 (c)(1),
(2) Date: Mar. 11, 2021

(87) PCT Pub. No.: WO2019/185736
PCT Pub. Date: Oct. 3, 2019

(65) Prior Publication Data

US 2021/0199284 A1 Jul. 1, 2021

(30) Foreign Application Priority Data

Mar. 29, 2018 (EP) ..... 18165013

(51) Int. Cl.
*F23C 15/00* (2006.01)
*F28G 7/00* (2006.01)

(52) U.S. Cl.
CPC ..... *F23C 15/00* (2013.01); *F28G 7/005* (2013.01)

(58) Field of Classification Search
CPC ..... F23C 15/00; G10K 15/043; F28G 7/005; F23J 3/02; F23J 3/023
See application file for complete search history.

(56) References Cited

U.S. PATENT DOCUMENTS 5,864,517 A 1/1999 Hinkey et al.
2008/0223244 A1 9/2008 Ruegg
(Continued)

FOREIGN PATENT DOCUMENTS

EP 1922568 B1 2/2018
EP 2319036 B1 4/2020
(Continued)

OTHER PUBLICATIONS

Füle, Tibor Horst, "Cleaning technologies with sonic horns and gas explosions at the waste-fired power plant of Offenbach (Germany)", VGB Powertech, Aug. 1, 2013, pp. 67-72, vol. 93 No. 8, VGB Powertech, Germany; cited in Specification and International Search Report; English abstract.
(Continued)

*Primary Examiner* — Alfred Basichas
(74) *Attorney, Agent, or Firm* — Rankin, Hill & Clark LLP

(57) ABSTRACT

A device for generating pressure waves of high amplitude, in particular for boiler cleaning, has a pressure-resistant container (21, 40) with a combustion chamber (121) inserted therein, which can be filled with a flowable burn-off material via supply lines. The pressure-resistant container has a discharge opening (306) for the directional discharge of gas pressure generated by ignition of the combustible material. A piston (70) closes the discharge opening, can release it for
(Continued)

Figure 1:
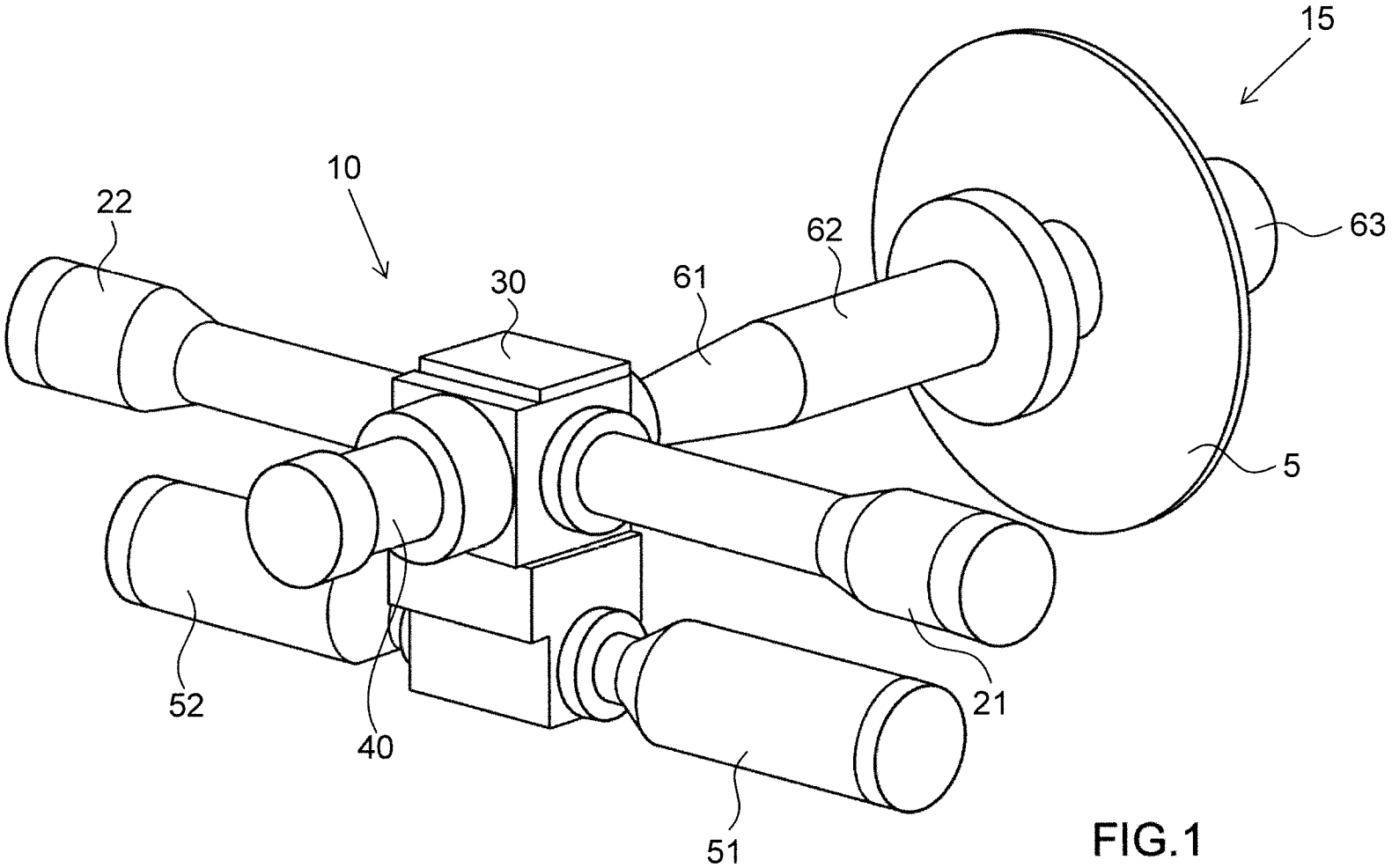

directional discharge and can be pushed back into the initial position by a spring device. With respect to its longitudinal direction (305), the seat of the piston (70) has a piston surface (302) inclined obliquely to the discharge opening (306), which is arranged opposite a housing surface (303) also inclined obliquely to the discharge opening (306), the housing surface (303) opening opposite the piston surface (302) at an angle (304) oriented towards the discharge opening (306) from a closure line (65) oriented perpendicularly to the piston direction (90).

8 Claims, 14 Drawing Sheets

(56) References Cited

U.S. PATENT DOCUMENTS

| | | | | |
|---|---|---|---|---|
| 2011/0180020 | A1 | 7/2011 | Ruegg | |
| 2021/0033118 | A1* | 2/2021 | Rüegg | G10K 15/043 |

FOREIGN PATENT DOCUMENTS

| | | | |
|---|---|---|---|
| FR | 2938623 | A1 | 5/2010 |
| WO | 2010025574 | A2 | 3/2010 |

OTHER PUBLICATIONS

International Search Report dated May 29, 2019 filed in PCT/EP2019/057752.

* cited by examiner

DEVICE AND METHOD FOR PRODUCING PRESSURE WAVES OF HIGH AMPLITUDE

TECHNICAL FIELD

The present invention concerns a device and a method for generating high amplitude pressure waves, in particular for cleaning boilers.

PRIOR ART

Such a device for generating high amplitude pressure waves is known from U.S. Pat. No. 5,864,517. This device generates acoustic oscillations which are significantly stronger than those which can be generated by loudspeakers. They can be used in particular for boiler cleaning, as these pressure waves lead to a detachment of attached particles. In the case of U.S. Pat. No. 5,864,517 two different pulsed burns are discussed, i.e. the detonation and the deflagration. Detonative combustion has an extremely fast flame speed of 2,000 to 4,000 m/s, while deflagrative combustion has much slower flame speeds such as less than 200 m/s and the pressure waves are of significantly lower amplitude.

EP 2 319 036 concerns a method and device for generating explosions, in particular high intensity pressure pulses. It consists of a pressure-resistant container with a main explosion chamber as in the above-mentioned US patent with an outlet for the pressure pulses and a piston closing the outlet. The piston is displaced in its position by an auxiliary explosion in an auxiliary explosion chamber in such a way that it releases the outlet opening. This procedure requires precise timing coordination between the triggering of the main explosion and the preceding auxiliary explosion. The device then also has a gas spring chamber that brakes the piston that has been pushed back and, after the gases have been blown out of the main explosion chamber, pushes the said piston back to its initial position.

EP 1 922 568 shows a further method and device for producing explosions. The gas spring mechanism has a relief mechanism which is revealed as a spring mechanism.

The article by Tibor Horst Rile "Cleaning technologies with sonic horns and gas explosions at the waste-fired power plant in Offenbach (Germany), cleaning with sonic horns and gas explosions at the waste-fired power plant Offenbach" in VGB Powertech, Vol. 93, No. 8, 1 Aug. 2013, pages 67-72, ISSN; 1435-3199 also reveals a method and device for generating explosions for cleaning with sonic horns.

Furthermore, the FR 2,938,623 shows an explosion cylinder with a piston that can be moved between an open and a closed position to cyclically generate explosions of gas or air under pressure for cleaning purposes.

PRESENTATION OF THE INVENTION

Based on this prior art, the invention has inter alia the object of specifying an improved device and method which is easier and safer to ignite.

In addition, one of the objectives of the invention is to provide the device with a longer maintenance interval, since the wear of the moving parts in the pressure-resistant container by the explosions is considerable and, in the state of the art, allows only a limited number of repetitions of the cleaning ignitions before the equipment needs to be maintained. Since in power plant engineering, primary industry and technical chemistry, the processes are usually carried out in complex chemical plants, a number of such devices for generating high-amplitude pressure waves are usually provided for cleaning the various vessels, which then have to be maintained accordingly.

The device is preferably used for cleaning boilers in large technical plants, such as waste incineration plants, coal-fired power stations, silos, for removing slag or deposits, etc. There the main advantage is that the individual cleaning cycles can be repeated very quickly and several times. Also, the use of gases as cleaning material to generate the sequence of pressure waves and associated pressure pulses is relatively inexpensive and high pressures can be generated. The addition of two chemical fluids, which do not burn or explode per se, at a time just before the pressure wave is triggered, also increases safety. It also makes it possible to clean while the plant is still warm and possibly still in operation, since the reacting substances are exposed to the hot environment for a long time.

The generated pressure wave can be directed via a tube over longer distances into a boiler to the place to be cleaned. The tube can be fixed to the plant to be cleaned, but can also be inserted from the outside, e.g. telescopically sliding into a plant or boiler. The pressure pulse generated during the burn-up blows off deposits and dirt from inner tubes in the boiler and its walls and at the same time sets the tubes or walls vibrating. Both actions cause an efficient cleaning of the equipment to be cleaned.

Various other uses are conceivable where a high, rapid force pulse, pressure pulse or pressure wave of high intensity and/or (rapid) repeatability is required. Examples are pressure generators for sheet metal forming or as a drive for firearms, where the pressure pulse is used to accelerate a projectile. It is also possible to use such systems in the field of controlled avalanche triggering.

A device for generating high amplitude pressure waves, especially for cleaning boilers, has a pressure-resistant container. This can be made up of several parts. It has at least one burn-up chamber placed inside it. Several burn-up chambers can be connected to each other. At least one ignition device reaching into the combustion chamber(s) is provided. There shall be at least one supply line for supplying a flowable combustible material to the combustor, preferably separately a fuel and an oxidant, for example natural gas and air or methane and oxygen. Various other liquid or gaseous fuels may also be used. In this case, the pressure-resistant container shall have a discharge opening for the directional release of gas pressure generated by the ignition of the combustible material in the combustion chamber. Before and during ignition, a closure means is provided which closes the discharge opening, is designed to open the discharge opening for directional discharge, and which can then be moved by a spring device into the initial position after burning down. The closing means is a piston which is displaceable in its longitudinal direction and which has a rear section aligned in the direction of the spring device and a front section aligned in the direction of the discharge opening.

With respect to its longitudinal direction, the seat of the piston has a piston surface inclined obliquely to the discharge opening, which is arranged opposite a housing surface also inclined obliquely to the discharge opening, whereby the housing surface opens opposite the piston surface at an angle directed towards the discharge opening from a closure line oriented perpendicularly to the piston direction.

The angle can be between 0.5 and 5 degrees, preferably between 1 and 3 degrees, especially 2 degrees.

The closure line oriented perpendicular to the piston direction can be located within the piston wall of the lower section so that a rounded static pressure opening area exists between the closure line and the piston wall.

A flange surface perpendicular to the piston axis, which is connected to or belongs to the combustion chamber, may have an area size between 50 and 200 percent of an area size given by the area size of the piston surface.

A transition area may be provided between these two sections. The front section is located in the area of the combustion chamber when the piston closes the discharge opening. In relation to the longitudinal direction of the piston, the front section is tapered in relation to the rear section, so that the transition area forms an effective surface oriented transversely to the longitudinal direction of the piston, on which a pressure is exerted that drives the piston back when the combustible material ignites, so that the front section of the piston opens the discharge opening. This makes cleaning easier, as the pressure build-up can also be achieved by burning off and is then itself responsible for opening the path to the discharge funnel.

The transition area can be an area that tapers continuously in the longitudinal direction of the piston of the gas spring from a larger piston diameter to a smaller piston diameter, which is located in the area of the combustion chambers. On the other hand, the transition area can also be formed by a flange-like taper of the piston.

In particular, a hollow central guide string may be provided in the pressure-resistant vessel, which in its interior guides the piston in the front area. This has advantages in terms of wear and tear of the piston guide, as it allows guidance over sections of the piston which are further apart. In this case, at least one connecting gap is provided between the combustion chambers and an auxiliary pressure chamber in the area of the flange-like taper of the piston.

The combustion chamber can be arranged in a ring around the piston around its longitudinal axis. In particular, the annular walls of the combustion chamber can then be stacked ring segments connected in a sealing manner, which are advantageously closed off by a top plate and a bottom plate at the top and bottom respectively. Thus, the height and volume of the cylindrical combustion chamber is easily scalable, since no special chambers of different sizes have to be provided. The only part of such a scaled combustion chamber is the correspondingly length-adjusted piston as a sealing unit.

At least two combustion chambers can be arranged in one plane at an angular distance from each other radially to a central axis. In particular, two combustion chambers can be arranged diametrically opposite each other. Then either the longitudinal axis of the gas spring coincides with the central axis; three burn-up chambers could then have an angular distance of 120 degrees in the common plane. Or the longitudinal axis of the gas spring also lies in the same plane as the at least two combustion chambers, so that with three combustion chambers an angular distance of 90 degrees between the individual elements is possible.

The exhaust port usually has a tube with a longitudinal direction of the tube. In this case, either the longitudinal direction of the tube can coincide with the central axis, i.e. the discharge opening is in the extension of the piston, or the longitudinal axis of the gas spring is in the same plane as the at least two combustion chambers. In this case, it is also possible, for example in the case of two combustion chambers, to provide an angular distance of less than 120 degrees between the two combustion chambers, so that they are more aligned with the outlet opening.

The gas spring can have a front gas spring chamber space opposite the piston and a rear gas spring chamber space separated from the piston by a partition, whereby between the front gas spring chamber space and the rear gas spring chamber space there is a first connection as a backflow connection and a second connection with a non-return valve, whereby the non-return valve is arranged in such a way that it allows an unhindered flow of medium from the front gas spring chamber into the rear gas spring chamber, but essentially blocks the opposite direction out of the rear gas spring chamber.

The first and second connections may be provided in the partition. On the other hand, the second connection can have at least two partial connections which, on the one hand, open laterally in the longitudinal direction of the piston movement one above the other in the wall of the gas spring in the front gas spring chamber space and, on the other hand, end in the rear gas spring chamber space, so that the openings are covered one after the other in time when the piston enters the front gas spring chamber space, each of the said partial connections having its own non-return valve. As a result, the individual non-return valves are successively switched off, so that the flow of medium from the front to the rear gas spring chamber slows down, i.e. the braking effect is reduced by the gas pressure build-up in the front gas spring chamber.

The second connection can have a controllable non-return valve, which can optionally have a control valve connected in series and a non-return valve, which controllable non-return valve is connected to a control unit with which the ignition can be triggered, the control unit being designed to open the controllable non-return valve at a first predetermined time interval after the ignition of the flowable, combustible material. This is to ensure that the burn-off in the combustion chamber is complete before allowing the piston to move back further.

The first connection may include a controllable backflow valve which may optionally include a control valve connected in series and a backflow guide, which controllable backflow valve is connected to the control unit with which the ignition is triggered, the control unit being arranged to open the controllable backflow valve at a second predetermined time interval after the opening of the controllable backflow valve. This makes it possible to activate the backflow delayed after the opening of the controllable non-return valve and thus the pressure equalisation between the front and rear gas spring pressure chamber, i.e. to trigger the closing movement of the piston later so that the combustion gases still under pressure leave the combustion chamber completely.

Two gas spring gas connections can also be provided separately for the front and rear gas spring chamber, whereby the control unit has a gas filling control unit with which the gas filling pressure in the front and in the rear gas spring chamber can be set to a predetermined value each before ignition, whereby the gas filling pressure in the front gas spring chamber can be set higher than in the rear gas spring chamber. In particular, the gas filling pressure in the front gas spring chamber can be set to be at least twice, preferably at least three times or five times higher than in the rear gas spring chamber, so that on the one hand the front gas spring pressure chamber does not recede or only slightly recedes on ignition, since the pressure prevailing in it on ignition opposes the pressure building up in the combustion chamber, and the receding only occurs completely and quickly when the non-return valve is opened, since a gas pressure difference has already been set. Especially in the rear chamber atmospheric pressure can prevail, while only the front gas spring pressure chamber has been pressurised with the inert gas.

In order to solve the problem of specifying an improved device and method which is easier and safer to ignite, a device for generating high amplitude pressure waves, in particular for cleaning boilers, comprising a pressure-resistant container with a combustion chamber inserted therein and at least one ignition device extending into the combustion chamber, with at least one supply line for supplying a flowable combustible material to the combustion chamber, the pressure-resistant container having a discharge opening for the directional discharge of gas pressure generated by the ignition of the combustible material in the combustion chamber and a closure means which closes the discharge opening, which is designed to release the discharge opening for the directional discharge and which can be displaced into the initial position by a spring device, characterised in that the closure means is a piston which is displaceable in its longitudinal direction and has a rear section aligned in the direction of the spring device and a front section aligned in the direction of the discharge opening, in that the front section is arranged in the region of the combustion chamber when the piston is in a position closing the discharge opening, in that, in relation to the longitudinal direction of the piston, the seat of the piston has a piston surface which is inclined obliquely to the discharge opening, opposite which is arranged a housing surface which is likewise inclined obliquely to the discharge opening, the housing surface opening opposite the piston surface at an angle, which is oriented towards the discharge opening, from a closure line which is oriented perpendicularly to the piston direction. This angle is advantageously between 0.5 and 3, especially 1 degree. The closure line oriented perpendicular to the piston direction is advantageously located within the piston wall of the lower section, so that a rounded static pressure opening surface exists between the closure line and the piston wall. This device also has the feature that the front section is tapered in relation to the longitudinal direction of the piston compared to the rear section. The taper concerns the inner piston seat wall and then preferably has an opposite outer housing valve seat wall, which opens inwards towards the outlet at a small angle.

Further embodiments are given in the dependent requirements.

SHORT DESCRIPTION OF THE DRAWINGS

Figure 2:
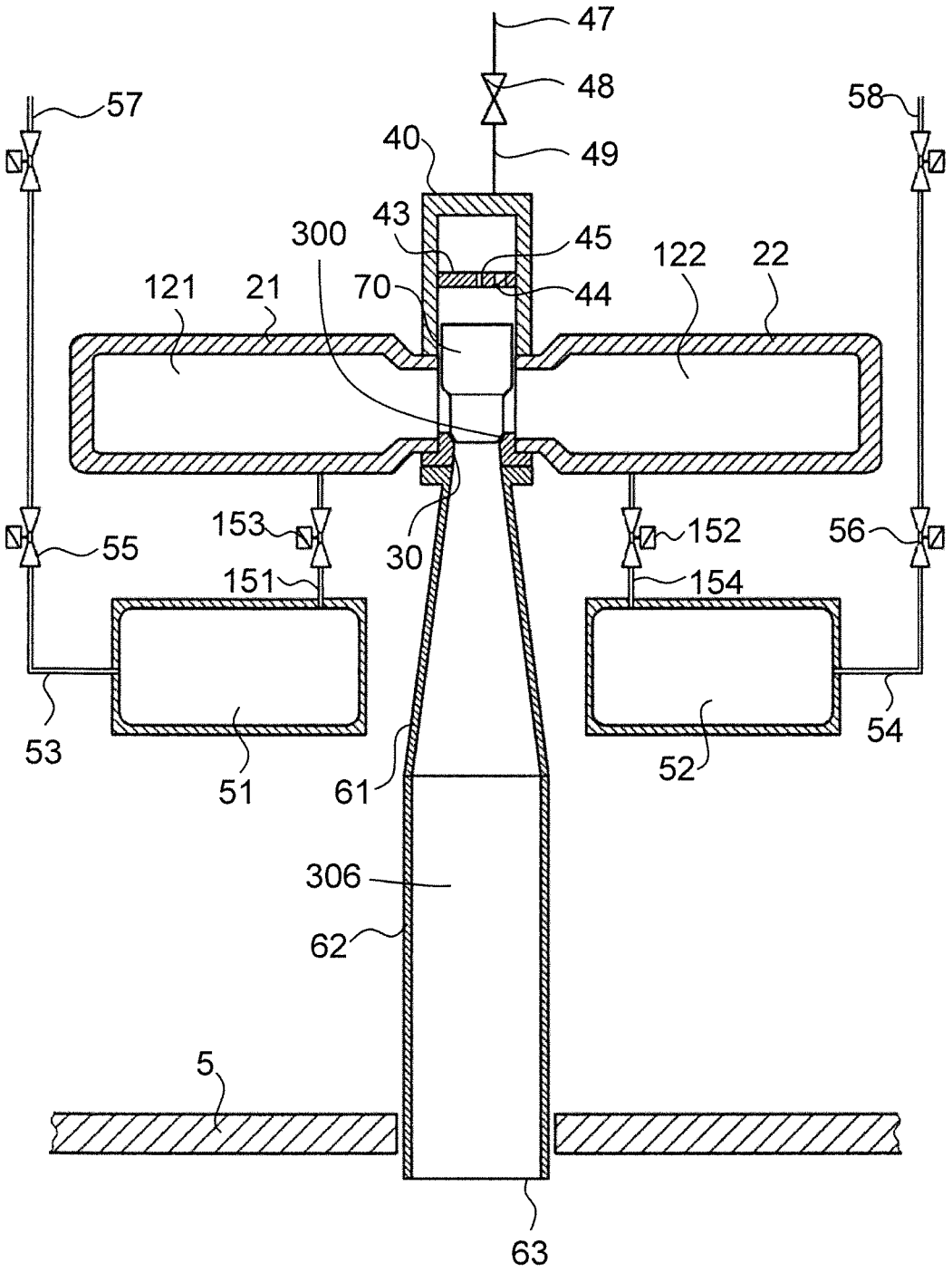
Figure 3:
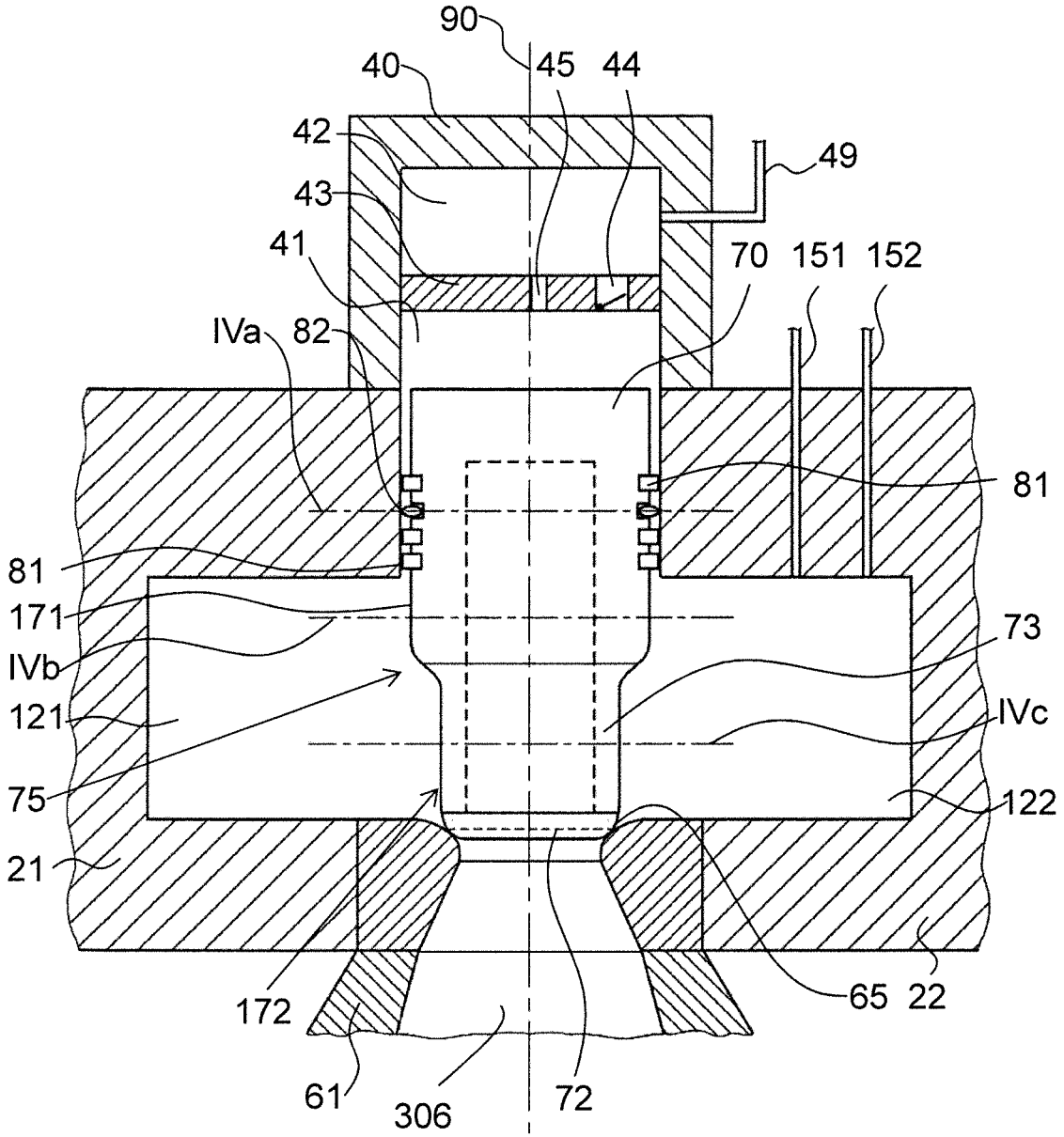
Figure 4A:
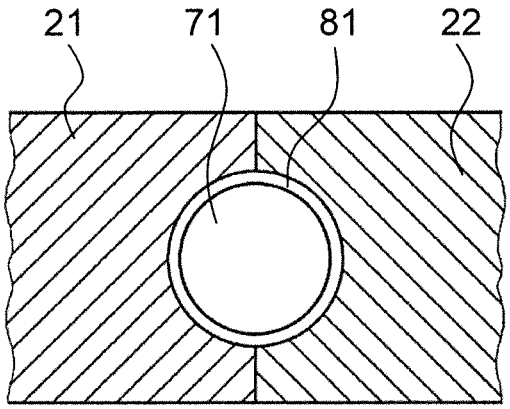
Figure 4B:
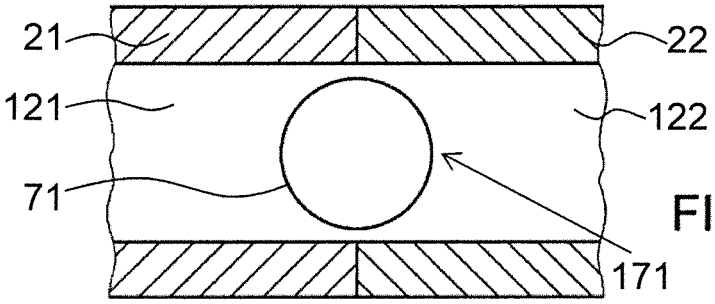
Figure 4C:
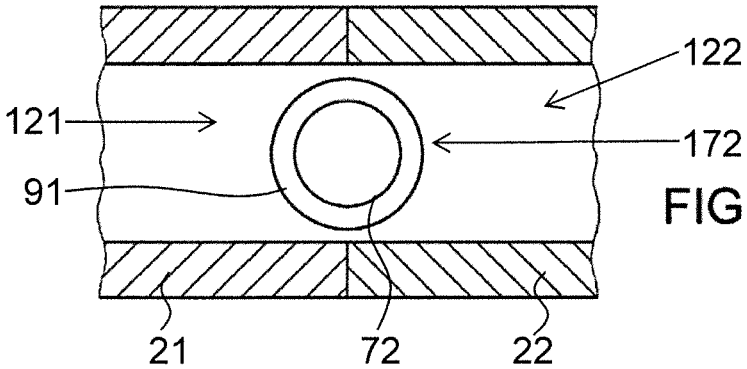
Figure 5:
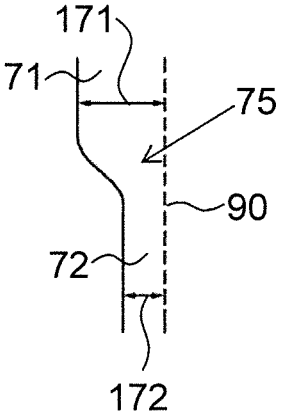
Figure 6:
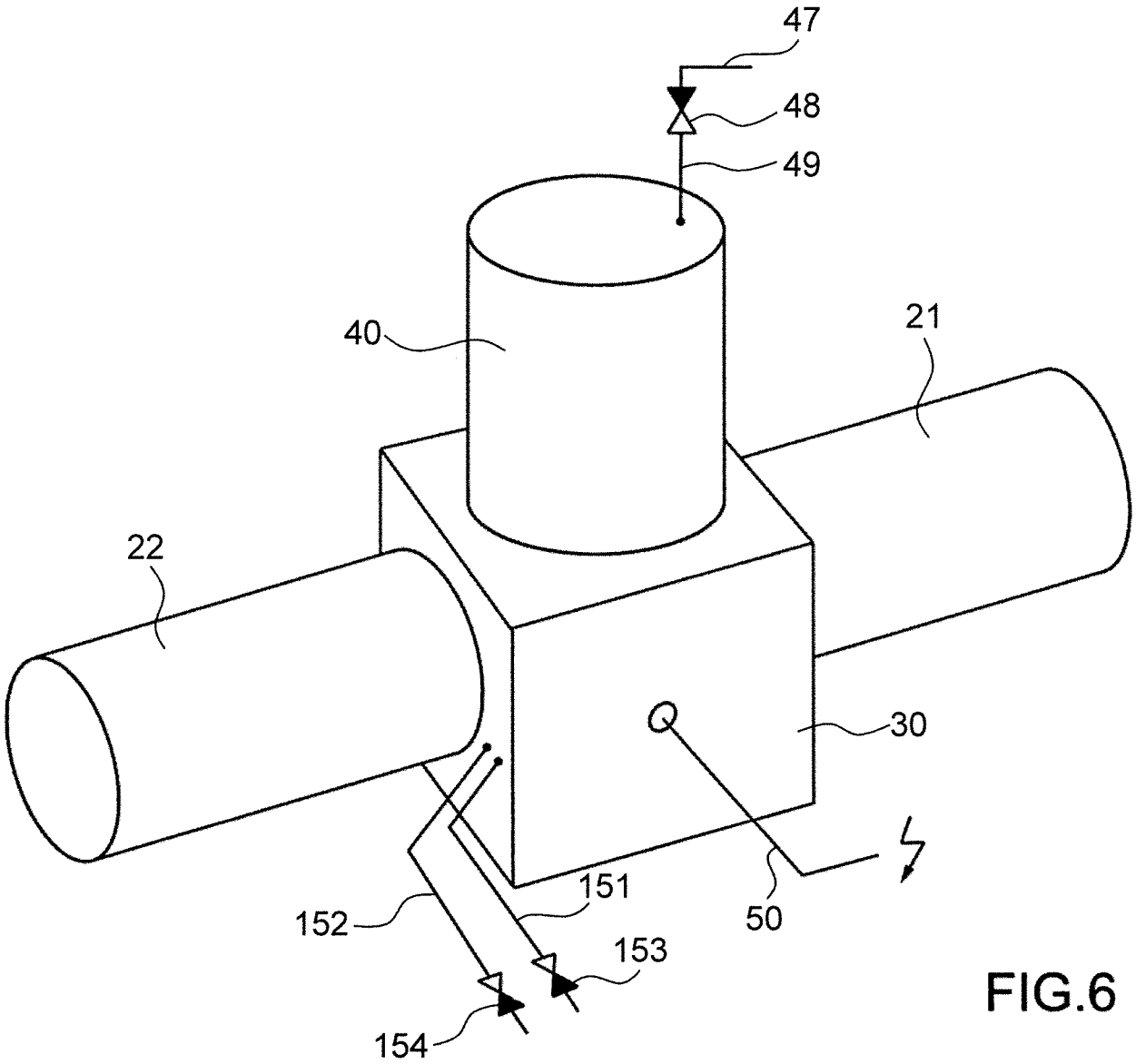
Figure 7:
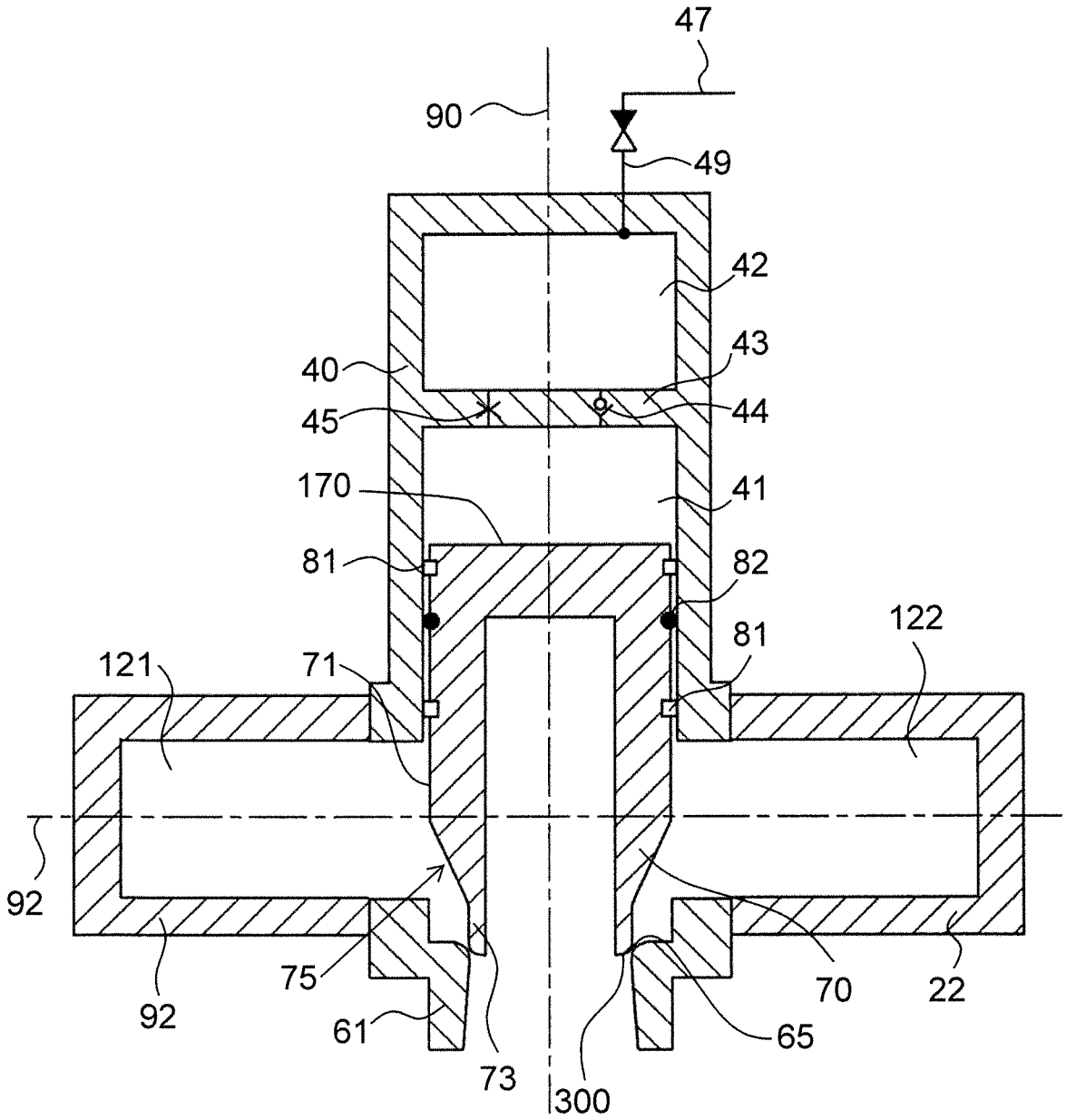
Figure 8:
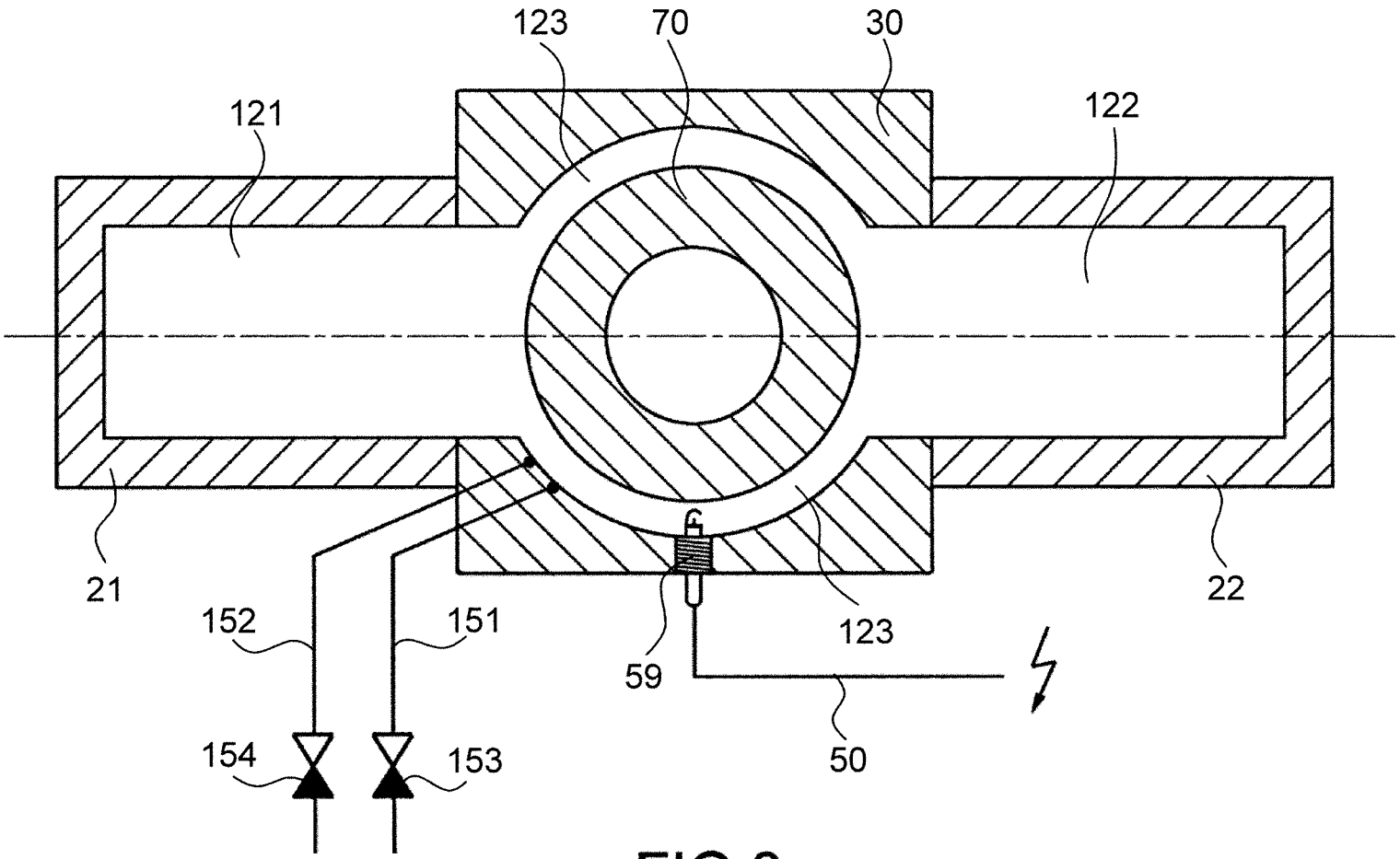
Figure 9:
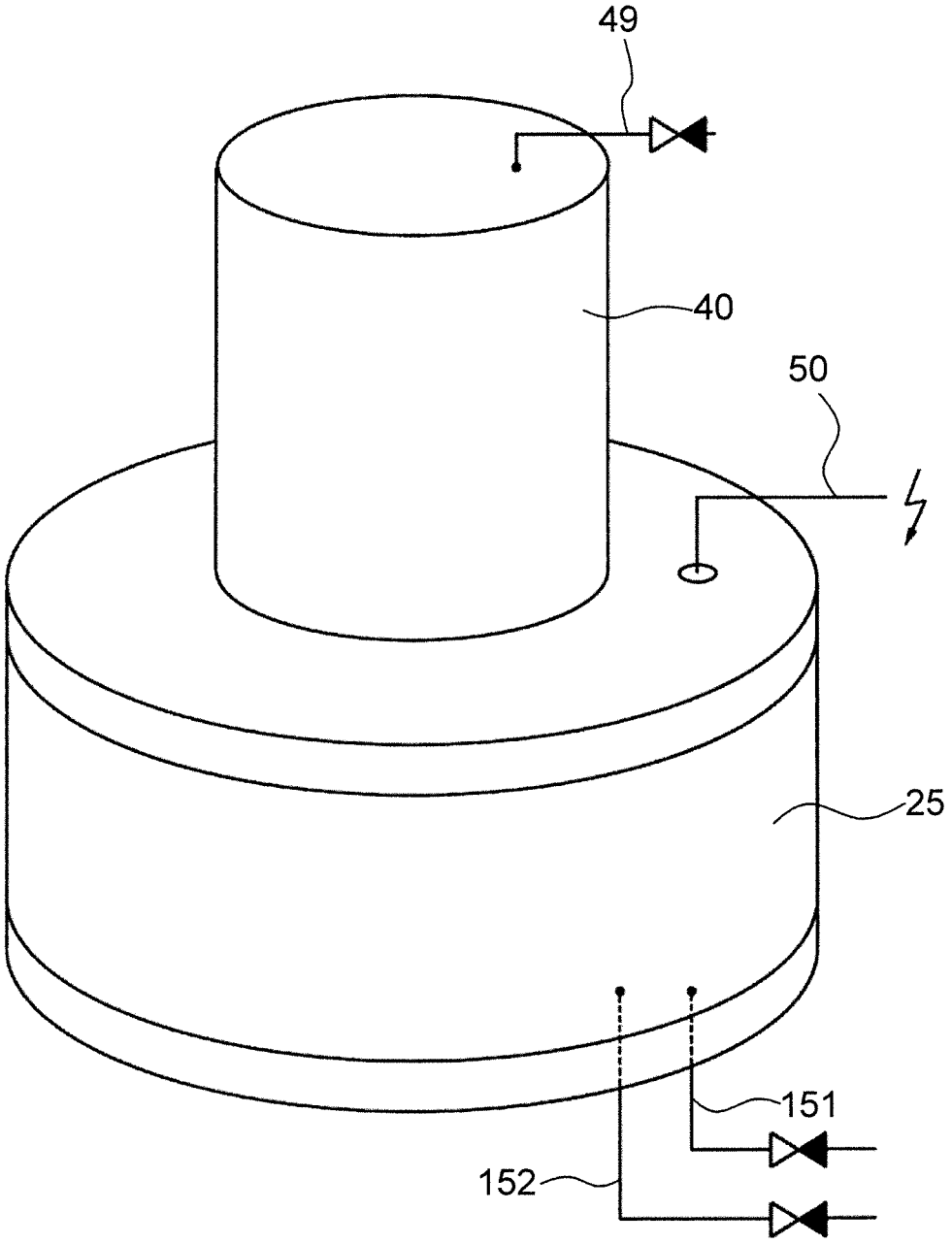
Figure 10:
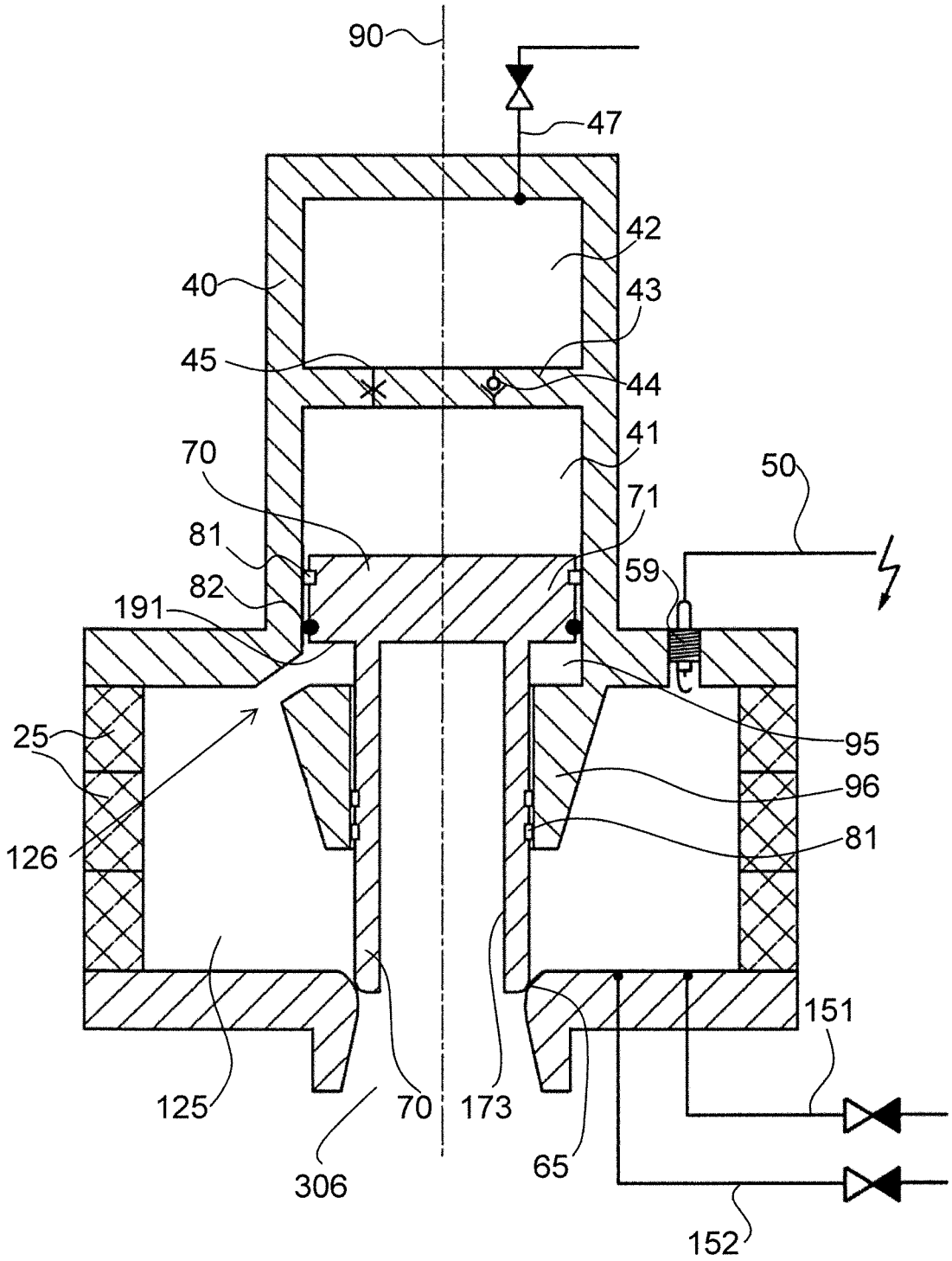
Figure 11:
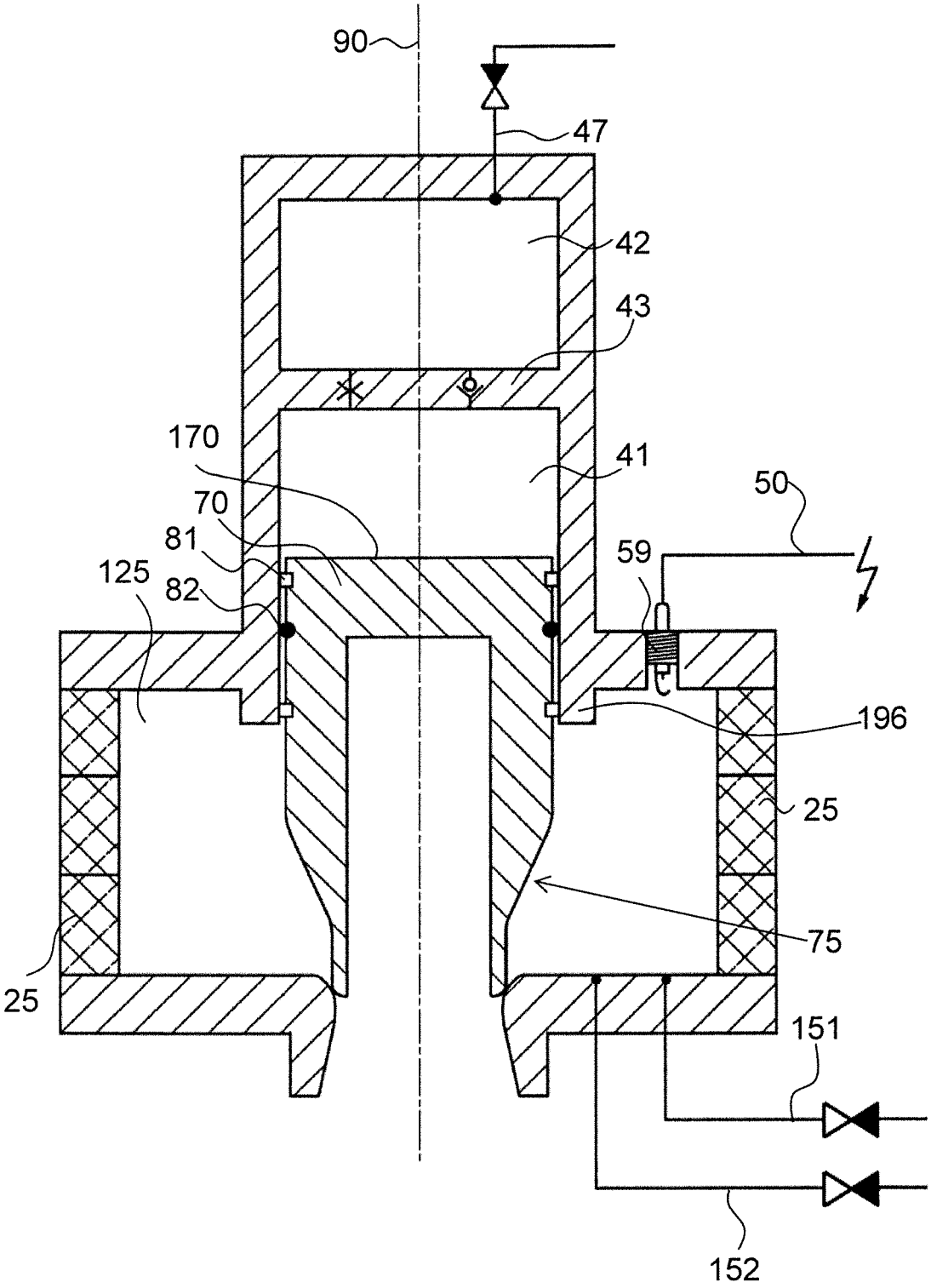
Figure 12:
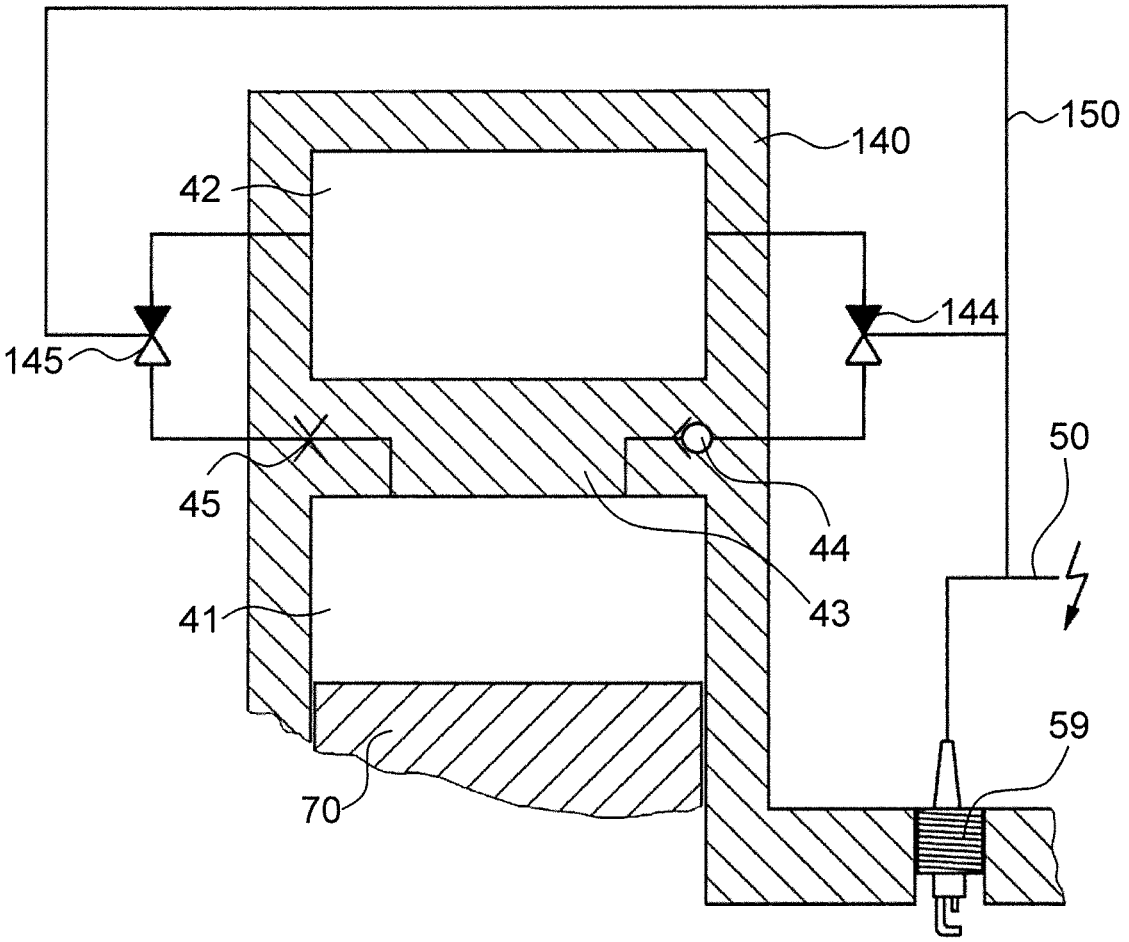
Figure 13:
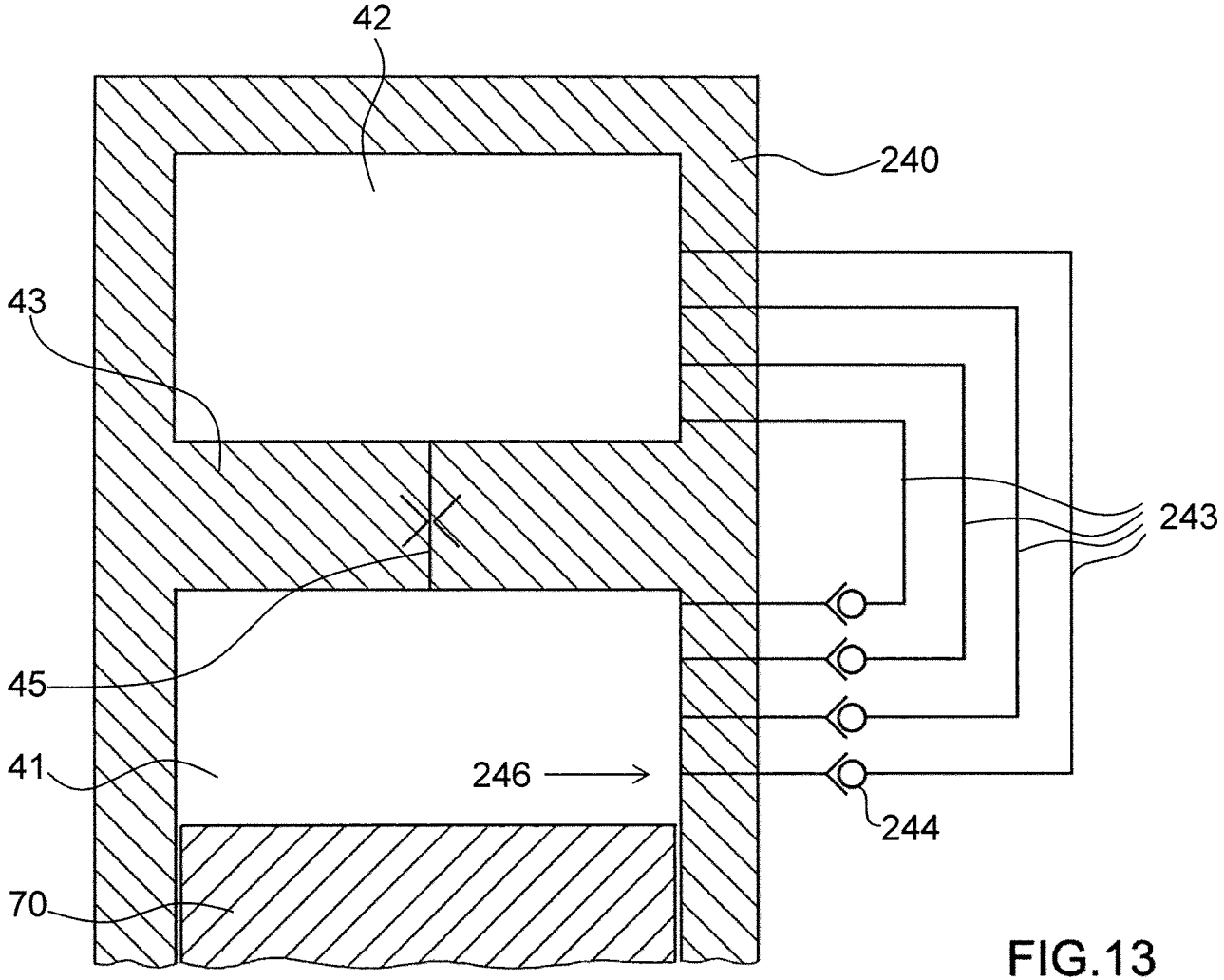
Figure 15A:
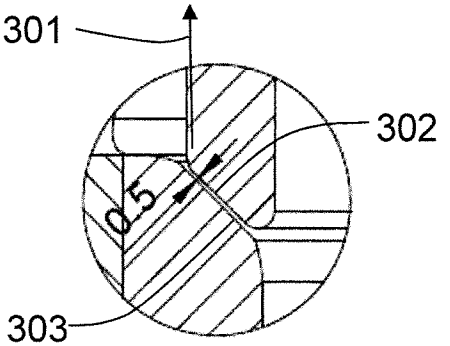
Figure 15B:
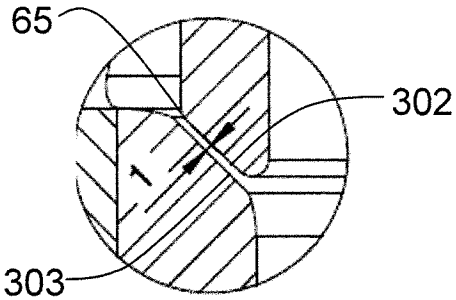
Figure 15C:
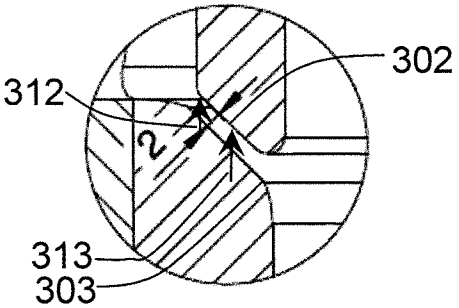
Figure 14:
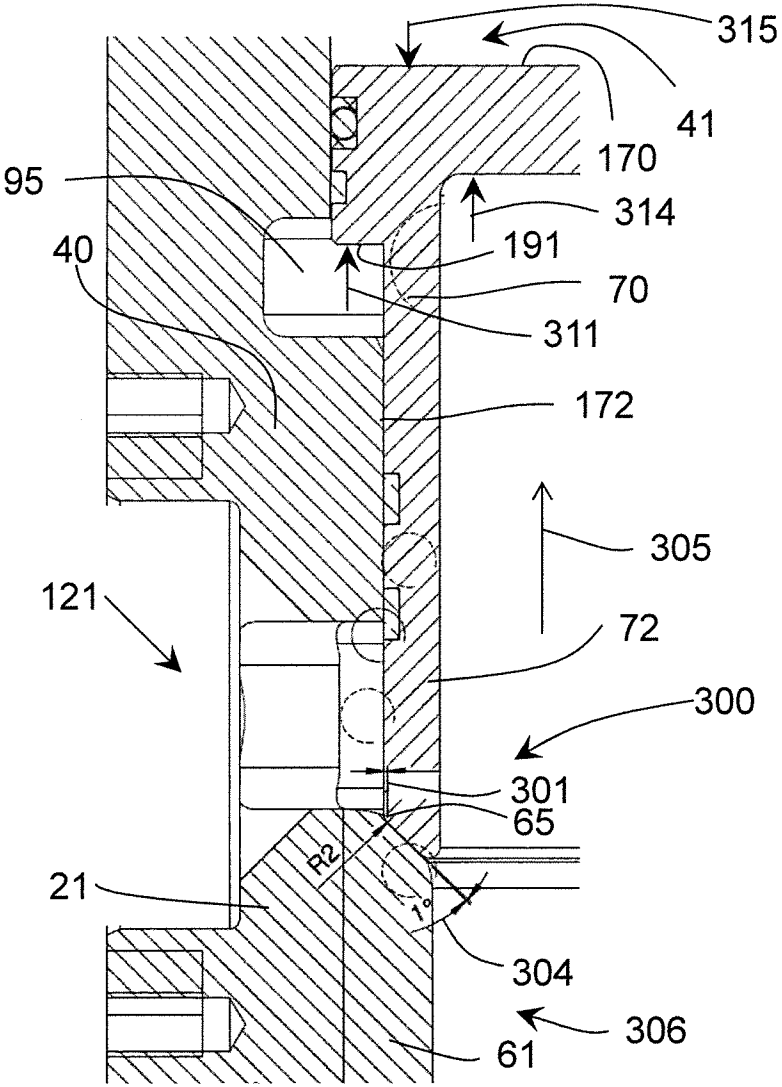
Figure 16:
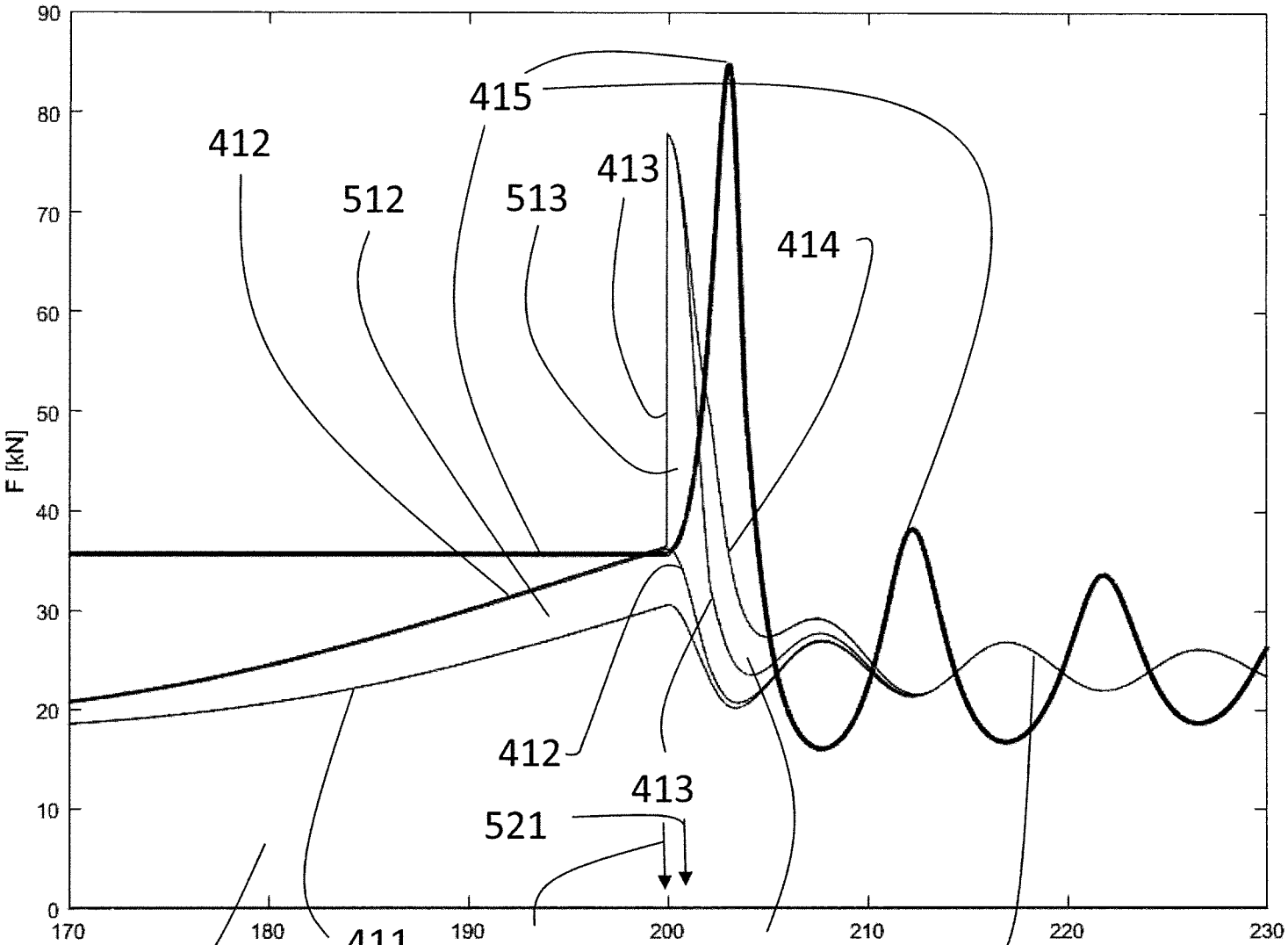

Preferred embodiments of the invention are described below on the basis of the drawings, which are for explanatory purposes only and should not be interpreted restrictively. The drawings show:

FIG. 1 a schematic perspective view of a device for generating high amplitude pressure waves according to an embodiment of the invention;

FIG. 2 a schematic view of the device according to FIG. 1;

FIG. 3 a lateral non-scaled sectional view of a device for generating pressure waves with its components essential to the invention;

FIGS. 4A, 4B & 4C in three superimposed cross-sections three horizontal sections through the device according to FIG. 3;

FIG. 5 a schematic detailed view of the piston from FIG. 3 between lines IVb and IVc;

FIG. 6 a schematic perspective view of another device for generating high amplitude pressure waves according to an embodiment of the invention;

FIG. 7 a schematic cross-sectional view with vertical sectional axis of the device according to FIG. 6;

FIG. 8 a schematic cross-sectional view with horizontal sectional axis of the device according to FIG. 6;

FIG. 9 a schematic perspective view of another device for generating high amplitude pressure waves according to an embodiment of the invention;

FIG. 10 a schematic cross-sectional view with vertical sectional axis of the device according to FIG. 9;

FIG. 11 a schematic cross-sectional view with a vertical sectional axis of a device with features partially according to the device according to FIG. 6 and according to FIG. 9;

FIG. 12 a schematic cross-sectional view with vertical sectional axis of an embodiment of a gas spring which can be used in a device according to FIG. 1, 6, 10 or 11;

FIG. 13 a schematic cross-sectional view with vertical sectional axis of another embodiment of a gas spring to be used in a device according to FIG. 1, 6, 10 or 11;

FIG. 14 a schematic partial view of a centre section of a device according to another embodiment of the invention, which can also be used in FIGS. 2, 3, 7, 10 and 11:

FIGS. 15A, 15B and 15C are detailed views of FIG. 14 at different times of an opening cycle; and FIG. 16 a force progression diagram over time for the embodiment of the valve seat for a device for generating high amplitude pressure waves.

DESCRIPTION OF PREFERRED EMBODIMENT

FIG. 1 shows a perspective view of a device for generating high amplitude pressure waves according to an embodiment of the invention. A first pressure-resistant container 21 and a second pressure-resistant container 22 are arranged to the left and right of a central body 30. In this embodiment, these containers 21 and 22 run essentially parallel to the vessel wall 5, which is shown in sections. In addition, a discharge funnel 61 with a downstream discharge tube 62 is flanged to the central body 30, which projects through the boiler wall 5 and ends in a discharge opening 63 in the interior of the boiler 15. In other embodiments the drain opening 63 can also be located directly on the boiler wall and the drain tube 62 can be designed shorter than the drain funnel 61 or omitted completely. Opposite the drain funnel 61, the gas spring pressure body 40 is flanged to the central body 30. In the lower part of the lower central body 30 there is a first gas supply container 51 on the left and right side and a second gas supply container 52 opposite. In other embodiments the construction of the containers 21 and 22 can be longer, i.e. an aspect ratio for the internal volume 121 and 122 of between 5:1 and 20:1.

The function of the device for generating pressure waves is now described in conjunction with the schematic diagram of the device shown in FIG. 1 with FIG. 2. This shows some essential elements of FIG. 1 in a schematic representation. The two left and right pressure-resistant containers 21 and 22 are arranged on the central body 30, which have a first burn-up chamber 121 and a second burn-up chamber 122 respectively. In the embodiment, the pressure-resistant tanks 21 and 22 are cylindrical with a larger-diameter interior space in the rear area, i.e. there is a tapered passage towards the central body 30.

In the central body 30 there is a piston 70, which will be shown in more detail in the following drawings, which separates the chambers 121 and 122 in front of each other when closed and closes the outlet with its front end 72 of the piston 70 towards the discharge funnel 61. The piston 70 projects with its upper part 71 into the gas spring pressure body 40 as shown in more detail in FIG. 3. The valve seat itself is marked with the reference numeral 300. This can be designed in particular according to FIG. 14 and the detailed views in FIG. 15A, 15B, 15C, in order to then develop the effect as shown in FIG. 16.

The purpose of the device for generating high amplitude pressure waves is to generate them in the first and second pressure chambers 121 and 122 by burning off a fluid fuel or explosive. This fuel is preferably formed by the mixing of components which are not flammable or explosive per se and which are stored in the first and second gas storage vessels 51 and 52. These gas reservoirs 51 and 52 are fed via external gas supply lines 53 and 54 from corresponding gas connections 57 and 58 which are controlled by external gas supply valves 55 and 56. The first gas storage vessel 51 is connected to the combustion chambers 121 and 122 via a first gas filling line 151 and an intermediate first gas filling valve 153. The illustration in FIG. 2 with the connection to only one combustion chamber 121 is also possible if corresponding compensation lines are provided between the first and second combustion chambers 121 and 122. Correspondingly, for the second gas connection 58, the second gas storage container 52 is directly or indirectly connected to the combustion chambers 121 and 122 via the second gas filling line 152 and the second gas filling valve 154. The design shown corresponds to a filling of the combustion chambers 121 and 122 via two metering tanks with subsequent inflow into the device. Otherwise it is also possible to fill the device directly via orifices.

Furthermore, a gas spring gas connection 47 is provided, whereby the gas for the gas spring 40 is fed into the gas spring interior 41 or 42, as shown in FIG. 3, via a gas spring supply valve 48 and a gas spring supply line 49.

In this embodiment we are talking about a first and a second gas. The first gas can, for example, be methane or natural gas, whereas the second gas can be oxygen or air or an oxygen-containing air mixture. In other embodiments, the flowable combustible material may be an explosive mixture, it may be gaseous, liquid, powder or a mixture of such materials.

The combustion chambers 121 and 122 are additionally connected to an ignition device which simultaneously triggers an ignition of the combustible material in the combustion chambers 121 and 122. If, as in the design of FIG. 6, an annular gap is provided, i.e. a volumetric connection of the two combustion chambers 121 and 122, then only one ignition device is necessary. Glow plugs or spark plugs can be used as ignition device. An intensified ignition by means of a spark plug, which has a higher ignition energy than a glow plug, the speed of the reaction can be increased. Thus a faster pressure build-up takes place in the combustion chambers 121 and 122.

When the ignition is triggered, a controlled burning or a controlled explosion of the combustible or explosive mixed components takes place in the combustion chambers 121 and 122, which exert a pressure on the piston 70 and there especially on the intermediate area 75, as it will be described in connection with FIG. 3. This leads to a movement of the piston 70 in its longitudinal direction against the pressure of the gas spring 40, which at the same time quickly opens the connection between the combustion chambers 121 and 122 and the exhaust funnel 61.

Prior to this, the outlet opening of the pressure-resistant container is kept closed by piston 70 as a closing means. The gas spring allows the closure to be kept closed even against the filling pressure of the combustible elements in the combustion chambers 121 and 122. Only when the pressure is increased during ignition of the flowable mixture is the pressure on the intermediate area 75 increased in such a way that piston 70 is pushed back accordingly. Subsequently, as will be described in connection with FIG. 3, the gas spring element then also causes the piston 70 to be pushed back as a closing means after the burn-off and allows the process to be directly repeated by refilling chambers 121 and 122. At the same time, a backflow of substances in the boiler into the device is reliably prevented.

The piston 70 is opened so quickly that the pressurised mixture in the combustion chambers 121 and 122 is still not completely burnt off when it escapes, so that the gas mixture in the discharge funnel continues to burn off, generating a pressure pulse with a high pressure peak.

When air is used as one of the two media besides $CH_4$ or natural gas, the chemical reaction takes place inside the combustion chambers 121 and 122 and all the energy is converted in the device. The gas is then released into the atmosphere by a subsequent, i.e. time-delayed rapid opening of piston 70 after the initial pressure build-up.

FIG. 3 shows a lateral sectional view in schematic representation of a device for generating pressure waves with its components essential to the invention.

The first and second pressure-resistant containers 21 and 22 are adjacent to the discharge funnel 61 inserted in them, which has a rounded valve seat contact 65 at its inner end. This valve seat contact 65, which is designed as a horizontal, essentially circular contact line running perpendicularly and concentrically to the piston longitudinal axis 90, is adjoined by the front end 72 of the piston 70, which is followed by the tapered piston area 73. Adjoining this tapered piston area 73 is a piston transition area 75, where the diameter of the piston is increased in order to have a larger diameter at the rear end of the piston 71. The rear piston diameter 171 is thus larger than the front piston diameter 172. In particular, the piston 70 has an area 91 (as shown in FIG. 4) in its longitudinal direction with a size sufficient to move the piston in the direction of the gas spring 40 during ignition. The diameter and height of the cavities of the gas spring 40 can be chosen larger in relation to the combustion chambers 121 and 122. The piston 70 is sealed between the walls of the left and right pressure-resistant container 21 and 22 by a sequence of seals 81 and 82 in its longitudinal direction. The three seals 81 may be bronze seals, while the seal 82 interposed between them is an O-ring. These seals 81 and 82 are embedded in grooves in the piston 70; they could also be provided in the opposite walls.

The piston 70, which is thus passed through the central body 30 with the pressure-resistant containers 21 and 22, then projects sealingly against the front gas spring chamber space 41 in the gas spring pressure body 40, which is separated from the rear gas spring chamber space 42 by a gas spring partition wall 43. A non-return valve 44 and a gas backflow opening 45 are provided in the gas spring partition wall.

The function of the gas spring is as follows. The two components of the combustible gas mixtures are fed through the gas filling lines 151 and 152 into chambers 121 and 122. These gases are ignited by an ignition device not shown in the drawing in FIG. 3. This exerts a pressure on the transition area 75, which overcomes the gas spring pressure which is holding against it and moves the piston 70 into the area of the front gas spring chamber 41. To ensure that this movement is sufficiently fast, the non-return valve 44 is provided in the partition 43, which opens immediately and quickly equalises the gas pressure between the front gas spring chamber 41 and the rear gas spring chamber 42, so that after an initial strong movement of the piston 70, it is then braked by increased resistance from the combined gas spring chambers 41 and 42. After pushing back the piston 70 in the direction of the partition 43, the combustible gases in burnt or still burning form escape from the exhaust funnel 61 and reduce the pressure in the combustion chambers 121 and 122. Since the valve in the gas spring partition 43 is a non-return valve 44, the gas spring chambers 41, 42 are then connected only by the gas return opening 45, which is much smaller in diameter. This then forces the gas of the gas spring from the rear gas spring chamber 42 back into the front gas spring chamber 41 and pushes the piston 70 into its initial position as shown in FIG. 3. Any loss of gas is compensated by the gas spring supply line 49. The gas in gas spring 40 can be air or an inert gas such as $N_2$.

FIG. 4 shows in three cross-sections one above the other FIG. 4*a*, FIG. 4*b* and FIG. 4*c* three cross-sections through the device as shown in FIG. 3 along the intersection lines IVa, IVb and IVc, respectively. The piston 70 has an advantageous round cross-section.

FIG. 4*a* shows a cross section along line IVa through the upper wall 21, 22 of the pressure-resistant containers. A bronze seal 81 is shown surrounding the rear section 71 of piston 70.

FIG. 4*b* shows a parallel sectional plane in the combustion chamber 121, 122 and through the combustion chamber 121, 122, a section along line IVb in the upper part of the space of the combustion chambers 121 and 122, where the piston 70 has the diameter of the rear section 71.

FIG. 4*c* then shows a further section along line IVc, parallel to the section of FIG. 4*b* in the lower part of the cavity, where it can be seen directly that although the width of the piston 70 in the central chamber area 30 abuts the walls of the pressure-resistant container 21, 22 and thus has a constant width over the length of the piston, the depth is smaller in the direction of the longitudinal alignment of the inner chambers 121, 122. Thus it can be seen directly here that there is a difference between the front piston diameter 172 and the rear piston diameter 171, whereby the term piston diameter here corresponds to the width in the longitudinal direction of the opposite combustion chambers 121, 122.

The drain opening 61 is shown here in all three drawings FIGS. 4*a*, 4*b* and 4*c* below the drawing plane. It is just as possible, as shown in FIG. 3 of the prior art document WO 2010/025574, that the discharge funnel 61 is connected in the longitudinal direction of the extension on the other side of the central body 30 to a combustion chamber 121 and the closing element as piston 70 is perpendicular to it, so that the gas mixture can escape directly straight ahead in the longitudinal direction of the entire device when the piston 70 is pushed back.

It is also possible to have two, three, four or more combustion chambers arranged in the plane of the combustion chambers 121 and 122 of FIG. 1, 2 or 6, corresponding to the sectional plane 92 of FIG. 7, since in all cases piston 70 is perpendicular to this plane of the combustion chambers and the discharge funnel 61. In an arrangement according to WO 2010/025574, the discharge funnel 61 would be in the same plane as all combustion chambers and can, for example, have the same angular distance to all of them. In the case of three combustion chambers, the funnels would be at 90 degrees to each other. The combustion chambers opposite the discharge funnel 61 can also be arranged closer together, so that the direction of air discharge does not have to be changed as much.

FIG. 5 shows an enlarged section of the transition area 75 of piston 70.

It can be seen that from the longitudinal axis 90 of the piston there is a first diameter 121, which is smaller than the rear piston diameter 171. Thus the transition area 75 forms two rectangular strips 91 in a section in the projection of the longitudinal axis 90, which serve as pressure transmission strips. When filling the combustion chambers 121 and 122, the pressure exerted on these strips 91 is not sufficient to push the piston 70 back against the gas spring pressure. This changes abruptly after ignition of the gas mixture, as a pressure difference of up to 25 to 30 times the filling pressure can occur, which is then sufficient to push back piston 70 with an appropriately adjusted gas spring tension. In the exemplary embodiments, the burnable chambers have a volume of between one and two litres, whereby the gas filling pressure can be between 10 and 30 bar, for example between 15 and 25 bar. The diameter of the annular opening closed by the piston is between 40 and 15 mm, in particular between 60 and 100 mm, and 80 mm in particular.

Ignition can be designed in a similar way to the prior art document WO 2010/025574 and can therefore be electrical or by light ignition, for example.

FIG. 6 shows a schematic perspective view of another device for generating high amplitude pressure waves according to an embodiment of the invention. Identical features are marked with identical reference signs throughout the description. On the central body 30 there are also two pressure-resistant containers 21 and 22 arranged and perpendicular to these the gas spring pressure body 40 is provided. The gas filling lines 151 and 152 lead into the central body 30 and the supply line of the ignition device 50 is shown in the centre of the central body 30.

FIG. 7 now shows a schematic cross-sectional view of the device according to FIG. 6 with a vertical sectional axis. The longitudinal axis of the piston 90, which corresponds to the longitudinal axis of the gas spring pressure body 40, crosses the horizontal central sectional plane 92 of the pressure bodies 21 and 22. Elements of the central body 30 have been omitted from the drawing in FIG. 7 to simplify matters. In the lower area, the pressure-resistant containers 21 and 22 reach up to the discharge funnel 61, with its inner end forming the valve seat contact 65 for the piston 70. The sealing line is a circular ring on the valve seat 300. The piston 70 has a tapered lower area 73, followed by the diameter-enlarging transition area 75, which leads into the rear piston area 71. Here the piston 70 is hollow. It can be in two parts, whereby the lower end can be inserted into the hollow piston 70 for contact with the valve seat 65. The valve seat 300 can again be designed as shown in FIG. 14.

The rear area of the piston 70 has sufficient height from the transition area 75 to its upper flat end face which defines the lower gas spring chamber space 41, so that even if the piston is pushed back into this front gas spring chamber space 41, the piston 70 will still be in substantial sealing contact with the inner walls of the gas spring 40 by means of the following sealing elements. According to the embodiment in FIG. 7, there are two bronze guides 81 which revolve around the piston 70 and a sealing O-ring 82 arranged between them. The bronze guides 81, which are arranged at a greater distance from each other, also have a sealing function and, like the O-ring 82, are mounted in corresponding circumferential grooves in the piston 70. In the gas spring partition 43, which is essentially perpendicular to the piston longitudinal axis 90, the non-return valve 44 and the gas backflow opening 45 are provided. The gas backflow opening 45 can also be called an orifice plate. The gas spring supply line 47 is connected to the rear end of the gas spring chamber 42, with which an inert gas such as nitrogen, $CO_2$ or argon can be externally filled via the gas spring gas connection 49. If the spring chamber chambers 41 and 42 are sufficiently sealed, the gas can also be air.

FIG. 8 shows the embodiment of FIG. 6 in the sectional plane 92, where it can be seen that the piston 70 is arranged at a constant distance in this central area from the inner wall of the central body 30 and that there is an annular gap 123 extending in the piston longitudinal axis direction 90, which is designed to balance the pressure between the two combustion chambers 121 and 122. Thus, in the present embodiment, a gas supply line 151 and 152 arranged next to each other is sufficient for the two gases or fluids to be mixed for burning. Centrally in the annular gap 123 between the combustion chambers 121 and 122, preferably also at the middle height of the central body, the glow plug or spark plug 59 is arranged reaching into the annular gap 123, which is connected to line 50 of the ignition device. Here orifices or metering valves 153 and 154 are provided so that direct filling of the combustion chambers 121 and 122 is carried out.

Such an annular gap 123 can also be guided on one side, i.e. only on the side of the spark plug 59 and it can also be used in other embodiments with two or more other combustion chambers.

FIG. 9 shows a schematic perspective view of another device for generating high amplitude pressure waves according to an example of the invention. Here, an arrangement symmetrical about the longitudinal axis 90 of the piston has been provided. In particular, a ring-shaped pressure-resistant container 25 is provided, into which the gas supply lines 151 and 152 lead. This pressure-resistant container 25 is arranged below the gas spring pressure body 40 in its extension and the ignition device supply line 50 is led into the interior of the device through the section of the pressure-resistant container 25 which protrudes beyond the gas spring body. The pressure-resistant container 25 consists of a top plate, a base plate and here a ring, which are placed together in a sealing manner. Several rings can also be arranged one above the other.

FIG. 10 shows a schematic cross-sectional view with vertical sectional axis of the device according to FIG. 9.

The gas spring 40 is formed in the same way as the other embodiments. There are two major structural differences compared to these other embodiments, which have been used together here. However, in other embodiments not shown in the figures, it is also possible to combine only one of the two differences described in the following examples with the other embodiments.

The first difference to the other embodiments is that there is an annular combustion chamber 125 which completely surrounds the piston 70. Thus there are ring-shaped elements of a pressure-resistant vessel 25, in this case three rings, which have been drawn as one ring due to the smooth flush outer surfaces in FIG. 9. Through the upper wall plate the spark plug 59 of the ignition device 50 is sealingly inserted into the ring-shaped combustion chamber 125. At another point, here shown in FIG. 10 from below, the two gas supply lines 151 and 152 are fed directly in. In other words, there are no gas storage tanks 51 and 52 as metering elements. This is controlled by the orifices 153 and 154 during filling.

The second difference between the other designs and the embodiments in FIGS. 9 and 10 is the design of the piston 70. The projection of the pressure area 91 of the other embodiments is here formed by an underside 191 of the piston 70, which underside and piston inside delimits an auxiliary pressure space 95. The lower side of this space is bordered on its underside by a downwardly tapering deflection profile strand 96, which has a uniform inner diameter, into which the lower section with the tapered piston area 173 runs, which is guided over two bronze seals 81 opposite the strand 96. When the combustible gas mixture supplied from lines 151 and 152 is ignited by the spark plug 59, the pressure in the annular combustion chamber 125 increases as in the previous examples, whereby here the pressure has the possibility of expanding into the auxiliary pressure chamber 95 via a connecting gap 126. Several such gaps 126 may also be provided, preferably at regular angular intervals to each other, so that the deflection profile 96 is fixed to the plate or gas spring pressure body except for these interruptions by the connecting gaps 126.

Thus, shortly after ignition, the internal pressure of the annular combustion chamber 125 acts on the underside of the rear end 71 of the piston 70 with its surface protruding over the core 191 in the auxiliary pressure chamber 95. Thus the pressure exerted on this surface 191, which corresponds to the pressure on the projection of the pressure surface 91 from the other embodiment, moves the piston 70 in its strand 96 backwards through the increasing auxiliary pressure chamber 95 into the front gas spring chamber 41, whereby here too a bronze seal 81 and an O-ring 82 are provided between the rear end of the piston 71 and the inner wall of the gas spring 40.

When the piston 70 moves backwards, the connection between the annular combustion chamber 125 and the exhaust funnel 61, which is not shown here, opens. The latter is characterised by the distance below the strand 96 and the valve seat 65. Also in this case the pressure of the burning or detonation of the media existing in the annular combustion chamber 125 acts on the receding piston 70.

FIG. 11 shows a schematic cross-sectional view with vertical sectional axis 90 of a device with features which partly correspond to the device according to FIG. 6 and partly to those of FIGS. 9 and 10.

It is a piston 70 according to the embodiment in FIGS. 1 and 6, which is surrounded by an annular combustion chamber 125 as shown in the embodiment in FIGS. 9 and 10. Thus the annular gap 123 is widened to the annular combustion chamber 125 and instead of two opposite combustion chambers 121 and 122 there is only one cylindrical one with a piston 70 as the core. Otherwise the function of pushing back the piston 70 is solved in exactly the same way by the pressure of the burning gas mixture exerted on the transition area 75. In FIG. 11 the gas spring pressure body is shown as a one-piece element with the cover of the ring-shaped (if the inserted piston 70 is considered as the central element) or otherwise cylindrical combustion chamber 125. Of course this can also be several elements flanged together. Essential for the illustration here is that the walls surrounding the rear section of the piston 70 have extensions 196 which protrude into the interior of the combustion chamber 125. These extensions 196, which are ring-shaped here, correspond to the strand 96 from FIG. 10 and serve for the further guidance of the piston 70. They can also be opposite bronze rings 81, which are embedded in the piston 70. In other words, it is advantageous to guide the piston 70 over a greater length and this can be achieved by a strand guided in the middle or by ring or ring segment shaped extensions 96.

The piston 70 itself can be hollow to save weight, being open to the front in the longitudinal direction 90, or it can also be made of a solid material, especially steel, or it can be hollow and have a plug inserted from the front, especially screwed in. This can also form the sealing surface to the valve seat 65.

FIG. 12 shows a schematic cross-sectional view with a vertical sectional axis 90 of another embodiment of a gas spring 140, whereby the wider area of the device with the piston 70 and the spark plug 59 and the combustion chambers and exhaust funnels not shown here can be designed similarly or identically. The main difference to the gas spring 40 is the external bypass of the non-return valve 44 outside the pressure body as well as the external bypass of the gas backflow opening 45 outside the pressure body. Both are therefore not guided inside the gas spring partition 43 between the two chambers 41 and 42 but have external valves 144 and 145. These orifices or control valves 144 and 145 are connected to the control line marked 150, which is also connected to the ignition device. Here the line 150 does not indicate a direct electrical or otherwise directly electrical control line, but symbolizes schematically that control signals are transmitted from a control unit not shown in the drawings to the spark plug 59 as well as to the valves 144 and 145, so that these switch with a corresponding time delay. After ignition, the non-return valve 44 is first switched continuously by valve 144, optionally with a slight delay, in order to brake the movement of the piston initially by a rapid pressure build-up in the front gas spring chamber 41 and to quickly achieve pressure equalisation with the rear gas spring chamber 42 after opening. The valve 145 for the backflow opening 45 is closed. It can also open in advance, as it only allows a small amount of gas to pass in the opposite direction. Afterwards, when all the gas has burned out and thus the pressure from chambers 41 and 42 should drive the piston back, orifice 145 opens and closes valve 144. With such controlled valves it is also no longer necessary to design elements 44 and 45 as check valves or orifice plates; they can also be simple lines.

Finally, FIG. 13 shows another schematic cross-sectional view with vertical sectional axis 90 of another embodiment of a gas spring 240, which can also be inserted into a device, for example as shown in FIG. 1, 6, 10 or 11. Here the non-return valve 244 is quadruple, while the gas backflow opening 45 is located in the gas spring intermediate wall 43, as in the other embodiments. The arrangement of four non-return valves 244, which is connected to the rear gas spring chamber space 42 via corresponding individual lines 243, results in an additional function in conjunction with the receding piston 70. The arrangement of the individual orifices 246 of the four non-return valves 244 are provided one above the other at intervals along the piston longitudinal axis 90 (not necessarily directly above one another, but also possibly laterally offset at an angular distance from one another), so that the receding piston 70, moving gradually from below, interrupts one after the other the orifices 246 and thus the connection to the non-return valves 244 from the connection between the front gas spring chamber 41 and the rear gas spring chamber 42. Thus, as the piston travel increases, i.e. the piston 70 moves back into the gas spring 240, the gas pressure balance between the front and rear spring chambers 41 and 42 via the check valves 244 is successively reduced, resulting in softer braking of the piston 70 in the front gas spring chamber 41 without the need for more complicated valve control. The closing of the check valves 244 is purely mechanical.

All of the embodiments shown above in connection with FIGS. 1 to 13 can be additionally or exclusively designed with the valve seat 300 explained in connection with FIG. 14, the function of which is explained in detailed views of a cross-section through the valve seat 300 in FIGS. 15A to 15C and the measured effects on the force curve acting on piston 70 over time are shown in FIG. 16.

FIG. 14 shows a sectional view of an outer wall 172 of a piston 70 of an embodiment of a valve seat 300 with further features. The outer wall in FIG. 14 is in contact with the opposite wall of the gas spring pressure body 40; it can also be in contact with the guide line 96. In this case the valve seat 300 is supported at the bottom by mating surfaces of the exhaust gas funnel 61. Between exhaust gas funnel 61 and gas spring pressure body 40 is an opening which leads into the first combustion chamber 121. Instead of the upper section of the exhaust gas funnel 61, there may also be a defined mating surface, which is assigned to the pressure-resistant container 21, 22, for example. The view in FIG. 14 is completed at the upper end of the piston by the piston surface 170, which is perpendicular to the side wall of the front piston diameter 172 and above which the (front) gas spring chamber 41 is provided. This design can be used for the embodiments in FIG. 2, 3, 7, 10, 11. The example shown here is similar to that in FIG. 10, in which an auxiliary pressure chamber 95 is provided, in which a flange surface 191 is a pressure surface for moving the piston 70.

A line 301 is drawn on the valve seat 300, indicating a distance from the side wall of the piston diameter 172. This is a distance that belongs to a bend R2, which belongs from the side wall 172 to the inner piston seat wall 302, which can be seen better in the detailed views of FIGS. 15A to 15C. This inner piston seat wall 302 lies opposite the outer or housing side valve seat wall 303. Here it is essential that the two walls 203 and 303, which essentially have an angle of approx. 45 degrees, in other embodiments not shown, between 30 and 60 degrees, in relation to the piston movement axis 305, are not parallel to each other but have an angle 304, which in the embodiment of FIG. 14 is given as 1 degree, but can also be formed between 0.5 and 5 degrees, in particular between 1 and 3 degrees.

The apex of the opening angle 304 is located at the intersection of the line 301, which indicates the end of the curvature of the piston 70, with the opposite outer casing side wall 303 and closes there in a circular ring the outer exhaust funnel chamber 306 from the (here shown) first combustion chamber 121, but of course also opposite the second combustion chamber 122.

This design of the valve seat 300 is shown in the chronological sequence of the explosion-like opening of the piston travel in FIG. 15A (start 0.5 mm), FIG. 15B (opening 1 mm), FIG. 15C (clear passage 2 mm), whereby reference is made to the force ratios shown in FIG. 16. Arrows 311, 312, 313, 314 and 315 are shown in FIG. 14 and FIG. 15C (only in the latter due to space conditions). These stand for the entire area on which they are placed. These are, if available, the optional prechamber surface 311, the static auxiliary surface 312, the dynamic auxiliary surface 313, the inner piston surface 314 and the gas spring surface 315, all of which are diametrically opposed.

The optional pre-chamber surface 311 is the flange extension in the auxiliary chamber pressure chamber 95. The static auxiliary surface 312 is the curved surface resulting from the distance 301 and the corresponding radius R2 at the front end of the piston in FIG. 14, which then, in the mathematical sense, merges smoothly into the inner piston seat wall 302. The dynamic auxiliary surface 313 is so designated because the angle 304 causes the two walls 302 and 303 to diverge in the direction of the discharge funnel chamber 306 and thus the surface develops dynamically. Here, the arrows 313 should be drawn in a sequence from the inner edge to close to arrow 312. Finally the inner surface 314 is drawn in the hollow of the hollow piston, but could also be at the lower end of the piston. Diametrically opposed to this, the gas spring surface 315 is provided.

FIG. 16 shows on the Y-axis the force acting on the piston 70 compared to the time on the X-axis. The basic action of the auxiliary pressure chamber 95 and its surface 311 is marked by line 411. Thus the area 511 between the O-line and the line 411 is a key figure for the prechamber action area. The line 412 shows the additional force effect, which results from the rounded surface at arrow 312 and is marked by the surface 512 between line 411 and line 412.

This force builds up until piston 70 lifts off the seat at time 520. Then the dynamic surface 313 comes into play and results in a boost, which is marked by line 413, and the effect is marked as an increase in force by the surface 513 located between line 412 and 413. A little later and with a slight delay, the counteraction of gas spring 40 comes into play, whose force effect is marked as line 415.

The increase in force known as boost ends at a point in time when the boost curve 413 is reversed at a slightly later point in time 521, when the diverging gap as shown in FIG. 15A to 15C has widened to a passage as shown in FIG. 15C. This does not mean that the slot is 2 mm wide, this depends on the depth of the valve seat, i.e. the distance from the rounding R2 (described by the line/arrow 301) to the beginning of the discharge funnel space 306. At this point in time 521 the line 414 separates from the line 413 in the downturn area.

With the line 414 and the corresponding force effect in the area 415, the emptying of the piston chambers is added in the downturn area, whereby the characteristic line 419 then forms a cumulative line and swings out in opposition to the gas spring line. In summary, the geometry of the valve seat has a positive effect on the opening behaviour of the piston.

During opening, the narrowest cross section shifts radially from the outside to the inside, so that the advantages are small projected areas in the closed state, which prevents unintentional opening. In the embodiment shown, the prechamber 95 ensures the initial opening at the desired time. However, it is possible to replace this auxiliary chamber by arranging the surfaces 191 in the main chamber 121 (i.e. without separate ignition, similar to the embodiment in FIG. 10), so that the surface 511 corresponds to an incipient ignition of the main chamber.

Because the narrowest cross-section shifts radially from the outside to the inside, the enlargement of the active area directly after the initial opening leads to a boost effect of the piston movement, which are shown in FIG. 15A to C in the initial opening movement.

LIST OF REFERENCE SIGNS

5 boiler wall
10 device
15 boiler interior
21 right-hand pressure-resistant container
22 left pressure-resistant container
25 ring-shaped pressure vessel
30 central body
40 gas spring pressure body
41 front gas spring chamber
42 rear gas spring chamber
43 gas spring partition wall
44 check valve
45 gas backflow opening
47 gas spring gas connection
48 gas spring feed valve
49 gas spring supply line
50 ignition device
51 first gas storage tank
52 second gas storage container
53 first external gas supply line
54 second external gas supply line
55 first gas supply valve
56 second gas supply valve
57 first gas connection
58 second gas connection
59 spark plug
61 drain funnel
62 drain pipe
63 drainage opening
65 valve seat contact
70 pistons
71 rear end of the piston
72 front end of the piston
73 tapered piston area
75 piston transition area
81 bronze seal
82 O-ring
90 longitudinal axis of piston
91 projection of the print area
92 horizontal plane
95 auxiliary pressure chamber
96 lead line
121 first combustion chamber
122 second combustion chamber
123 combustion chamber annular gap
125 annular combustion chamber
126 rejuvenating rope
140 gas spring
144 non-return control valve
145 backflow control valve
151 first gas filling line
152 second gas filling line
153 first gas filling valve
154 second gas filling valve
170 piston surface
171 rear piston diameter
172 front piston diameter
173 tapered piston area
175 piston flange transition
191 flange surface
196 ring-shaped guide extensions
240 gas spring
243 connecting cable
246 line mouth
300 valve seat
301 line indicating the end of the bend
302 inner piston seat wall
303 outer housing side valve seat wall
304 angle between 302 and 303
305 piston movement axis (opening)
306 discharge funnel chamber
311 antechamber area
312 static auxiliary surface
313 dynamic help surface
314 inner surface of piston
315 gas spring area
411 antechamber line of action

412 static area effect line
413 boost action line
414 piston emptying line
415 gas spring action line
419 totals line
511 antechamber area
512 static effective area
513 boost effective area
514 piston emptying effective area
520 piston opening time
521 passage at piston seat open

The invention claimed is:

1. A device for generating pressure waves of high amplitude, comprising:

a pressure-resistant container;

a combustion chamber inserted in the pressure-resistant container;

at least one ignition unit extending into the combustion chamber;

at least one supply line for supplying a flowable combustible material into the combustion chamber;

a discharge opening provided in the pressure-resistant container for the directed discharge of gas pressure caused by the ignition of the combustible material in the combustion chamber a piston which comprises a front section, a rear section, and a piston seat having a piston surface; and a spring configured to displace the piston into a starting position;

wherein the discharge opening has a housing surface opposite to the piston surface, wherein the piston is displaceable in its longitudinal direction to close the discharge opening at a closure line and to release the discharge opening for a directed discharge, wherein the rear section of the piston is oriented in a direction of the spring, wherein the front section of the piston is oriented in a direction of the discharge opening and is arranged in a region of the combustion chamber when the piston is in a position closing the discharge opening, wherein, with respect to the longitudinal direction of the piston, the piston surface is inclined obliquely to the discharge opening, wherein the housing surface is also inclined obliquely to the discharge opening, and wherein, starting from the closure line which is oriented perpendicularly to the longitudinal direction of the piston, an angle is opening, oriented towards the discharge opening, between the housing surface and the piston surface.

2. The device according to claim 1, wherein the angle is between 0.5 and 5 degrees.

3. The device according to claim 1, wherein the closure line is arranged within a piston wall of the front section so that a rounded static pressure opening surface is created between the closure line and the piston wall.

4. The device according to claim 1, wherein a flange surface, which is perpendicular to the piston direction and is connected to or is part of the combustion chamber, has an area size which is between 50 and 200 percent of an area size of the piston surface.

5. The device according to claim 1, wherein upon opening of the discharge opening the piston surface becomes a dynamic auxiliary surface with an active surface being aligned transversely with respect to the longitudinal direction of the piston and on which a pressure which drives the piston back is exerted when the combustible material ignites, so that the front section of the piston opens the discharge opening, since the narrowest cross section between the housing surface and the piston surface shifts radially from the outside to the inside in view of the longitudinal axis of the piston.

6. The device according to claim 1, wherein the spring is a gas spring.

7. The device according to claim 1, wherein the combustion chamber is arranged annularly or cylindrically around the piston about its longitudinal axis.

8. The device according to claim 7, wherein the annular walls of the combustion chamber are sealingly connected ring segments which are stacked and closed off at the top and bottom by a cover plate and a bottom plate.

* * * * *